US012076836B2

(12) United States Patent
Gottfried

(10) Patent No.: US 12,076,836 B2
(45) Date of Patent: Sep. 3, 2024

(54) ROTARY CRUSHER AND FEEDER FOR ICE BLASTING SYSTEM

(71) Applicant: Coulson Ice Blast Ltd., Port Alberni (CA)

(72) Inventor: Kristjan Gottfried, Port Alberni (CA)

(73) Assignee: Coulson Ice Blast Ltd., Port Alberni (CA)

( * ) Notice: Subject to any disclaimer, the term of this patent is extended or adjusted under 35 U.S.C. 154(b) by 443 days.

(21) Appl. No.: 17/442,008

(22) PCT Filed: Mar. 23, 2020

(86) PCT No.: PCT/CA2020/050381
§ 371 (c)(1),
(2) Date: Sep. 22, 2021

(87) PCT Pub. No.: WO2020/191487
PCT Pub. Date: Oct. 1, 2020

(65) Prior Publication Data

US 2022/0176516 A1 Jun. 9, 2022

Related U.S. Application Data

(60) Provisional application No. 62/822,819, filed on Mar. 23, 2019.

(51) Int. Cl.
*B24C 1/00* (2006.01)
*B24C 3/06* (2006.01)
*B24C 7/00* (2006.01)

(52) U.S. Cl.
CPC ..... *B24C 1/003* (2013.01); *B24C 3/06* (2013.01); *B24C 7/0092* (2013.01)

(58) Field of Classification Search
CPC .. B24C 1/00; B24C 1/003; B24C 7/00; B24C 7/0015; B24C 7/003; B24C 7/0046;
(Continued)

(56) References Cited

U.S. PATENT DOCUMENTS 2,640,629 A 6/1953 Thomson et al.
2018/0318982 A1* 11/2018 Coulson ..... B24C 1/003
2019/0321942 A1* 10/2019 Mallaley ..... F16K 31/1225

FOREIGN PATENT DOCUMENTS

DE 102010004211 A1 * 7/2011 ..... B24C 1/003
KR 102059843 B1 * 12/2019
(Continued)

OTHER PUBLICATIONS

DE102010004211—Machine Translation (Year: 2011).*
KR102059843—Machine Translation (Year: 2019).*

*Primary Examiner* — Brian D Keller
*Assistant Examiner* — Alberto Saenz
(74) *Attorney, Agent, or Firm* — Flaster Greenberg P.C.

(57) ABSTRACT

An ice blasting system comprising a hopper to receive bulk ice and a rotary crusher disposed inside the hopper, the rotary crusher having rotary crusher arms that cooperate with anvils to produce crushed ice from the bulk ice. The system includes a rotary feeder mechanism disposed below the hopper, the rotary feeder mechanism having a rotor that includes ice-receiving pockets for receiving the crushed ice. The rotor rotates against an airtight seal block and delivers the crushed ice into a high-pressure airstream passing through the rotary feeder mechanism to thereby entrain the crushed ice into the high-pressure airstream whereby the ice-entrained airstream subsequently exits the ice blasting system through an outlet.

8 Claims, 15 Drawing Sheets

(58) Field of Classification Search
CPC ... B24C 7/0053; B24C 7/0061; B24C 7/0069; B24C 7/0092; B24C 3/06; B24C 3/062; B08B 3/026; B02C 4/02; B02C 4/08; B02C 4/30; B02C 11/04; B02C 1/00; B02C 1/02; B02C 1/04; B02C 1/043; B02C 1/06; B02C 1/08; B02C 1/10; B02C 1/14; F25C 5/04; F25C 5/043; F25C 5/046; F25C 5/14
USPC ..... 451/38, 39, 40, 92, 94, 99; 241/264, 241/265, 266, 270, 271, 272
See application file for complete search history.

(56) References Cited

FOREIGN PATENT DOCUMENTS

| | | | | |
|---|---|---|---|---|
| WO | WO 9104449 | A1 | * | 4/1991 |
| WO | WO 02/20217 | A1 | | 3/2002 |
| WO | WO 03/089192 | A1 | | 10/2003 |
| WO | WO 2017/127935 | A1 | | 8/2017 |

* cited by examiner

ROTARY CRUSHER AND FEEDER FOR ICE BLASTING SYSTEM

CROSS-REFERENCE TO RELATED APPLICATIONS

This application is a 371 U.S. national phase of PCT international patent application number PCT/CA2020/050381, filed Mar. 23, 2020, which claims benefit and priority to U.S. provisional patent application No. 62/822,819 filed Mar. 23, 2019. The disclosure of each aforementioned application is incorporated by reference herein in its entirety. Specifically, PCT international patent application number PCT/CA2020/050381 is incorporated by reference herein in its entirety. And, U.S. provisional patent application No. 62/822,819 is incorporated by reference herein in its entirety.

TECHNICAL FIELD

The present invention relates generally to ice blasting systems including water, $CO_2$ ice, and other frozen blast media, and more particularly to a machine which provides an improved method of crushing, sizing, and delivering the raw ice particles into the high-pressure transport fluid.

BACKGROUND

An apparatus for ice blasting is disclosed in Applicant's Canadian Patent 2,964,016. The apparatus described in that patent makes use of an ice crushing mechanism that comprises a pair of jaws arranged in a V shape. These jaws are connected through a linkage that allows them to move in a reciprocating manner and concurrently crush and move the crushed ice particles into the feeder mechanism.

Although the V-shaped crusher jaws generally work well, Applicant has observed that the V-shaped crusher jaws can become clogged in certain conditions. The V-shaped crusher jaws cause the volume of the feeder staging area to be alternately compressed and expanded. If this volume becomes filled with ice particles due to the feeder not removing crushed ice at a fast enough rate, the compression of this volume will pack the ice into a very hard immovable mass. This in turn will prevent the jaws from reciprocating and cause a motor overload.

An improved mechanism for an ice blasting system is therefore highly desirable.

SUMMARY

The present invention provides a novel rotary crusher mechanism for an ice blasting machine. Instead of V-shaped crusher jaws (dual-jaw reciprocating system), the present disclosure presents a rotary crusher mechanism. A series of plates with radially protruding rotary crusher arms are stacked on a shaft and spaced by an amount that will determine the ultimate size of the ice particles created. This rotating shaft with rotary crusher arms is placed in close proximity to a stationary anvil. This anvil has protruding anvil arms that are interleaved with the rotary crusher arms on the rotating shaft. The anvil is shaped in such a way as to prevent ice particles from escaping the system, and instead are guided along the path of the rotating crusher arms and into the feeder staging area. The rotor with arms can also be made from a single machined, cast, or otherwise monolithic piece, as can the anvil. Alternately, the arms and spacers can be combined into one or more sets of parts.

The rotating shaft is connected to a drive motor that provides the crushing power. This rotating shaft and stationary anvil assembly is placed beneath the hopper so bulk (un-crushed) ice particles can fall into contact with the rotating crusher arms. As the shaft rotates, ice particles in contact with the crusher arms are pulled towards and into contact with the stationary anvil arms. As the crusher arms continue to rotate, the ice is crushed between the stationary anvil arms and rotating crusher arms and pulled downwards through the gaps between the stationary anvil arms where it can then fall into the feeder mechanism situated below the crusher assembly.

Accordingly, one inventive aspect of the present invention is an ice blasting system comprising a hopper to receive bulk ice and a rotary crusher disposed inside the hopper, the rotary crusher having rotary crusher arms that cooperate with anvils to produce crushed ice from the bulk ice. The system includes a rotary feeder mechanism disposed below the hopper, the rotary feeder mechanism having a rotor that includes ice-receiving pockets for receiving the crushed ice. The rotor rotates against an airtight seal block and delivers the crushed ice into a high-pressure airstream passing through the rotary feeder mechanism to thereby entrain the crushed ice into the high-pressure airstream whereby the ice-entrained airstream subsequently exits the ice blasting system through an outlet.

Another inventive aspect of the present invention is an ice blasting system comprising a hopper to receive bulk ice, a V-shaped shaped crusher having crushing teeth to crush the bulk ice to make crushed ice, a rotary feeder mechanism disposed below the hopper, the rotary feeder mechanism having a rotor that includes ice-receiving pockets for receiving the crushed ice, wherein the rotor rotates against an airtight seal block and delivers the crushed ice into a high-pressure airstream passing through the rotary feeder mechanism to thereby entrain the crushed ice into the high-pressure airstream whereby the ice-entrained airstream subsequently exits the ice blasting system through an outlet, and a comb-block attached to an ice piston to push the crushed ice into the ice-receiving pockets.

The foregoing presents a simplified summary of the invention in order to provide a basic understanding of some aspects of the invention. This summary is not an exhaustive overview of the invention. It is not intended to identify essential, key or critical elements of the invention or to delineate the scope of the invention. Its sole purpose is to present some concepts in a simplified form as a prelude to the more detailed description that is discussed later. Other aspects of the invention are described below in relation to the accompanying drawings.

BRIEF DESCRIPTION OF DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
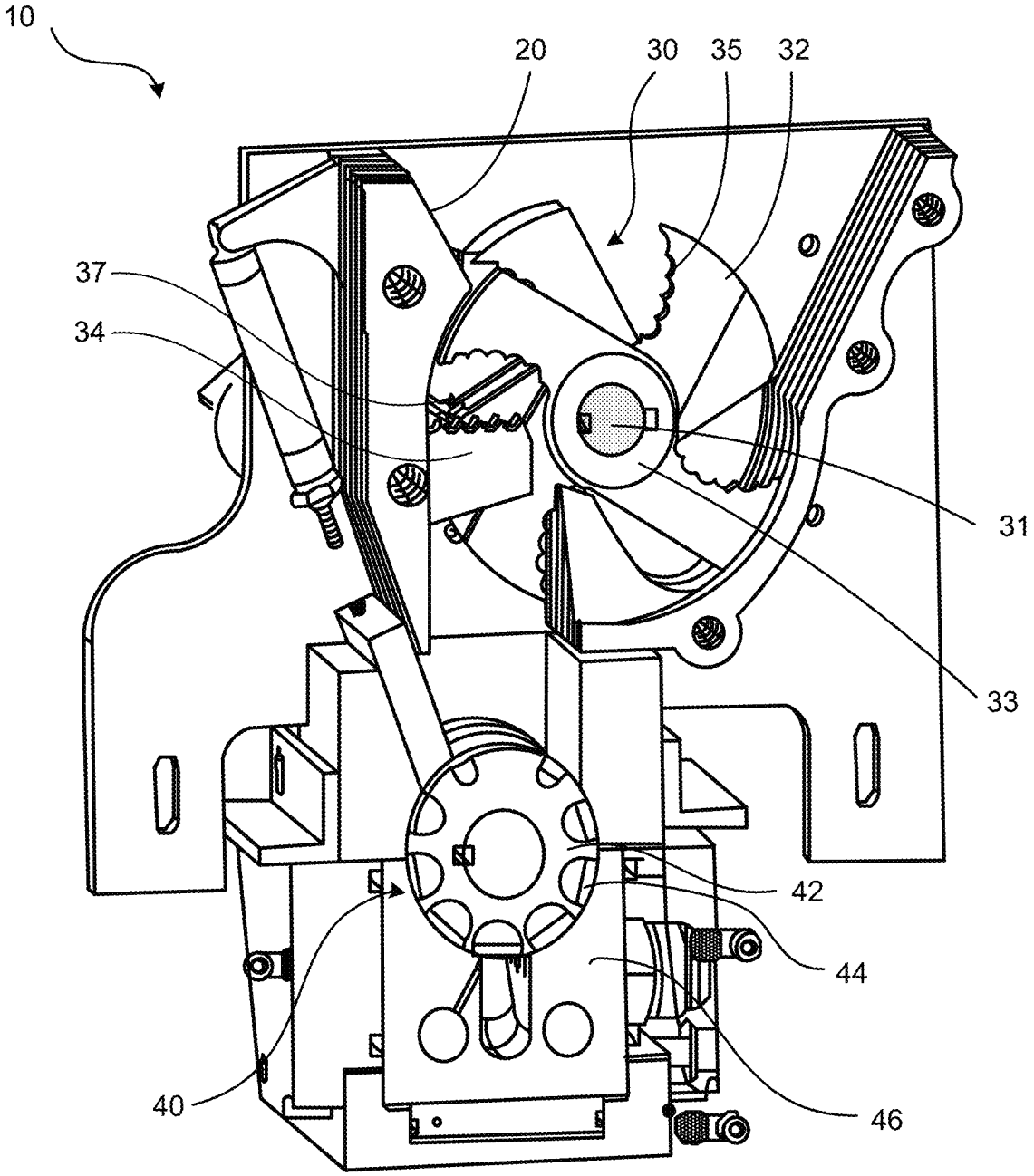
FIG. 1 is a cutaway view of the crusher, showing a crusher shaft, spacers, rotary crusher teeth, anvils, anvil spacers, guide spacers, cleaner teeth, and the pneumatically activated ice piston.

Disclosed herein is a novel ice blasting system having a rotary crusher. The rotary crusher has many advantages over the V-jaw crusher design. The rotary crusher can be made significantly lighter and with less complex components. Also, due to its rotary crushing arm motion, the rotary crusher pulls crushed ice through the mechanism at a much greater rate for a given motor speed.

Another major advantage of the rotary crusher design over the V-jaw crusher is its resistance to overloading. The V-jaw crusher motion causes the volume of the feeder staging area to be alternately compressed and expanded. If this volume becomes filled with ice particles due to the feeder not removing crushed ice at a fast enough rate, the compression of this volume will pack the ice into a very hard immovable mass. This in turn will prevent the jaws from reciprocating and cause a motor overload.

The rotary crusher does not share this compressed volume problem with the V-jaw crusher. If the feeder does not carry away enough ice, then the extra ice brought in by the rotary crusher is simply pulled back out of the feeder area and back up into the hopper. If the feeder were to stop altogether, the ice would simply be circulated around by the rotating crusher arms and would never get packed into a dense and immovable mass.

This is particularly important when operating the system with very small diameter media particles in the hopper. If the media particles are smaller than the gaps between the crusher teeth, such as with dry-ice pellets, then they will tend to flow past the crusher mechanism without needing to be crushed further. This will cause the feeder staging area to be immediately filled completely with media particles which would then cause the motor overloading issue in the V-jaw type crusher. However, the rotary crusher in this case would simply circulate the media that has fallen into the feeder staging area back up into the hopper, preventing motor overload.

This would allow use of any sized media in the hopper without the requirement to disengage the crusher teeth if the media size (i.e. average size of the ice blasting particles) is too small. This greatly simplifies the design requirements for such a system.

The rotary crusher mechanism differs from the V-jaw crusher system in another important way. The V-jaw crusher has, in at least some embodiments, an alternating pushing action on ice particles in the feeder staging area. This action presses on the ice particles and forces them into the pockets in the rotor surface. For a clean and dry blasting media, this action is not necessary, but for a wet, sticky, and clumpy blasting media such as water ice at warmer temperatures this type of active pressing action is required to prevent the blasting media from clumping and forming a bridge over the feeder which would prevent any further blasting media from reaching the feeder pockets.

The V-jaw crusher can benefit greatly by adding a flat paddle or block to the bottom of the crushing teeth so that with each cycle of the drive motor, the blocks will alternately press down on the crusher ice and force it into the feeder mechanism. This block or paddle would need to be attached in a way that did not interfere with the tooth crushing action. In a preferred embodiment, a comb-like block surrounds the bottom portion of the crushing teeth to allow the teeth to move slightly to prevent binding.

Since the rotary crusher has substantially less direct action pressing the media particles into the feeder pockets, it may be necessary in some situations to employ a dedicated mechanism to push the crusher media into the feeder from the feeder staging area. This mechanism can take the form of a plate or block that through reciprocating rotary or sliding action acts to push the media into the feeder pockets and then retract in a cyclical manner. This plate or block can be driven by a linkage powered off the main crusher drive motor, or it could be powered by its own motor. Alternately, this plate or block could be actuated by one or more hydraulic or pneumatic cylinders.

Using a pneumatic cylinder would be particularly useful, as the blasting system already has a large supply of high-pressure air. It also has the benefit of having an inherently limiting contact pressure. If too much blast media fills the feeder staging area, then the ice pushing block would simply stop moving and apply a constant pressure proportional to the pressure in the actuating cylinder. If other motor-driven mechanical methods are used to move the plate or block, then there is a risk of overloading the motor if the feeder staging area becomes too full of crushed blast media.

This pushing action can also be accomplished with an auger or other rotary media transport mechanism, although these types of systems are more susceptible to over-filling and subsequent overloading.

The hopper of the ice blasting system can be improved by adding an agitation system to keep the uncrushed ice cubes flowing freely into the crusher. This can be accomplished through conventional vibrators, or it can be achieved through a novel hopper shaking mechanism. In a preferred embodiment of this system, the hopper rests on a bar with a pivoting bearing. The other side of the hopper rests on a hard stop plate that sits on either the body of the crusher or the frame of the machine. On the side with the flat plate, there is a lifting rod or other pushing mechanism that alternately pushes on the hopper and releases it so that it alternately is lifted a small distance and then dropped so that it strikes the hard stop plate. This can be accomplished with a rotating cam on a shaft to lift the lifting rods, or the rod can be pneumatically or hydraulically activated, or be activated with a linear solenoid motor. The lifting rod component might not be present, with the cam, pneumatics, hydraulics, or electric actuator acting directly on the hopper to lift it.

This system would allow a large number of possible motion paths and patterns for the hopper. These can include a rapid shaking, lifting and dropping, sudden lifting with slow release, sine wave motion, and others. The preferred embodiment uses a slower lifting stroke with a sudden dropping action to allow the hopper to strike with some force against the hard stop. This action should be best at breaking up clumps of frozen ice and other media.

The rotor crushing arms can have a number of features to improve their crushing action. The crushing arms can be made from aluminum that has been anodized, e.g. with a Type III anodized hard coating. This would allow the parts to be very light and low cost, while still retaining high durability and abrasion resistance. Alternately, the crushing arms could be made from stainless steel. If an austenitic stainless steel is used, then the corrosion resistance will be high, but the material will be soft and the crusher arms may become dull over time. If a martensitic stainless steel such as 420 stainless steel is used, then the arms could be hardened or nitrided and be much more durable. Other metal alloys and plastics can be used for these rotors.

The arms can be made to have a series of sharp points or serrations along their cutting lengths. These would act to increase the local crushing pressure at the points and cause the ice to split. This will greatly reduce the required crushing pressure when compared to a flat sided crushing arm. The points could be spaced and shaped in such a way as to encourage the formation of ice particles that are close to the maximum size permitted by the arm spacing. The shape of the cutting face of the arms can be flat or curved. If the cutting faces are a concave curve, this would act to pull the unbroken ice chunks into the middle of the crushing zone and help prevent ice from escaping before being crushed.

The teeth of the crusher blades and the teeth on the anvils can also be shaped in such a way as to create a scissoring action as they pass each other. If the crusher blades are tilted forwardly, and the anvil blades are sloped back from the direction of rotation, then the crusher teeth would first contact the anvil blades at the very tip, with the point of intersection then moving radially down the blades towards the hub or vice versa with contact starting near the hub and moving radially outwards to the tip. A scissoring action such as this would minimize the area of the blades that are actively crushing and shearing the ice, which would result in significantly less torque required to turn the rotors and subsequently a smaller motor requirement.

This rotary crusher mechanism can be oriented with a horizontal shaft as shown in the preferred embodiments. Or alternately it can be oriented with the shaft vertically. The ice would then be loaded into the machine from what is the side of the blades on the horizontal version of the machine. The ice would get pulled through the various levels of the crusher, with the bottom blades being perhaps closest spaced. Then the ice would fall into a hole above a rotary disk feeder. This feeder is a thin disk with an array of holes in it, with the disk being turned by the center drive shaft that runs the crusher. There is an inlet hole and an outlet hole with the outlet hole being at high pressure. There are seals to prevent leakage from the outlet hole to the inlet hole.

The crusher with vertical or horizontal shafting could be combined with either the cylindrical feeder or the disk-type feeder.

The feeder mechanism described in Canadian Patent 2,964,016 is a rotary type with radial pockets on the cylindrical surface for transport of the crushed ice particles past a sealing surface into the high pressure transport fluid.

The present disclosure provides some improvements to this feeder mechanism. In the earlier version of the feeder, the rotor was a single piece of anodized aluminum with shaft stubs extending from each end. It is beneficial to change this arrangement so that the rotor now comprises an outer tube of anodized aluminum with a hollow bore and a through-shaft that mates with this bore. This through-shaft can be made from a different material than the outer portion of the rotor which can improve fatigue strength and facilitate replacement of the outer tube if it becomes overly worn.

The through-shaft is mechanically coupled to the outer rotor tube through a keyway or some other type of torque transfer mechanism such as a spline. It is beneficial to have the keyway run the entire length of the through shaft to avoid the creation of stress concentrators at the keyway terminating edges. The keyway can be of any profile shape, with a round profile being particularly beneficial for fatigue loading.

The outer portion of the rotor that contacts the seal block can benefit from having holes that are spaced in a spiral pattern. The profile of the holes can be such that they comprise a lofted cut where the outer surface approximates a circle and the bottom of the pocket approximating an oval. This will maximize the volume of the pockets for each rotor revolution.

The concave sealing block in the feeder will benefit, in at least some embodiments, from having pressure-activated panels acting on the side walls of the block as well as on the bottom face of the block. These pressure-activated panels will act to press the seal block into the rotor face to accomplish a more positive seal.

Since these plates are pressure activated, they will follow the load created by the pressurized rotor cavity. The size of the plates can be adjusted such that this load from the pressurized rotor cavity is balanced by the forces from the pressure plates. This allows the total net contacting force of the seal block on the rotor to be as small as possible, which in turn will greatly reduce the friction forces on the rotor and subsequently the power required to drive the feeder.

The sealing block contains flow passages to allow the high-pressure transport fluid to travel from the inlet piping, past the rotor where it entrains the blasting media particles, and then out to the outlet hose. These passages can benefit from having a series of holes with reduced flow area to accelerate the fluid and direct this flow so that it impinges directly on the rotor and its associated pockets. This will create more force to scour the pockets and remove all of the collected blasting media as efficiently as possible.

The sealing block in the preferred embodiment is made from ultrahigh molecular weight (UHMW) plastic. This plastic has a much higher coefficient of thermal expansion than the surrounding metal and therefore tends to shrink much more than the metal housing it rests in when cooled to low temperatures, such as those created by application of dry ice. Some embodiments of the present invention make use of mechanical sealing inserts at each end of the sealing block that have a balanced pressure area that forces them into contact with the housing wall when pressurized. There is a radial seal around the circumference of the sealing inserts that allows the inserts to slide as the seal block material shrinks and expands, while maintaining its positive seal with the seal block housing. This action prevents catastrophic seal blowout when the seal block reaches low temperatures such as when dry ice media is left in contact with the seal block for long periods of time.

The invention will now be further described with regard to the embodiments depicted by way of example in the drawings.

FIGS. 1-15 depict an ice blasting system in accordance with embodiments of the invention which are considered to represent the best mode of implementing the invention. In the embodiments depicted in FIGS. 1-15, the air blasting system 10 (or ice blasting machine) comprises a hopper 20 to receive bulk ice (blocks of ice, ice cubes, etc.) and a rotary crusher 30 disposed inside the hopper. The hopper as shown by way of example in FIGS. 1-4 is a generally V-shaped hopper, i.e. a downwardly converging hopper.

In the embodiments depicted in FIGS. 1-15, the rotary crusher 30 has rotary crusher arms 32 that cooperate with anvils 34 to produce crushed ice from the bulk ice. In the embodiments depicted in FIGS. 1-15, the ice blasting system includes a rotary feeder mechanism 40 disposed below the hopper. The rotary feeder mechanism 40 has a rotor 42 that includes ice-receiving pockets 44 for receiving the crushed ice from the hopper. In operation, the rotor rotates against an airtight seal block 46 and delivers the crushed ice into a high-pressure airstream passing through the rotary feeder mechanism to thereby entrain the crushed ice into the high-pressure airstream. The ice-entrained airstream subsequently exits the ice blasting system through an outlet 48. The outlet may be connected to a hose and nozzle for performing ice blasting, for example on a surface to be cleaned.

FIG. 1 is a cutaway view of the rotary crusher 30 and rotary feeder mechanism 40. As shown in FIG. 1, the rotary crusher 30 has a crusher shaft 31 and a hub 33 from which the crusher arms 32 extend radially outwardly. In the illustrated embodiment, there are two rotary crusher arms per hub although the number of arms per hub can be varied in other embodiments. To accommodate the rotation of the crusher arms, the hopper has a V-shaped upper hopper portion and a semicircular lower hopper portion.

In the embodiment shown in FIG. 1, the rotary crusher arms 32 have serrations (or sharp points) forming rotary crusher teeth 35. The teeth may be equally spaced and equally sized in one embodiment. In other embodiments, the teeth may be of different size and/or unequally spaced.

In the embodiment shown in FIG. 1, the anvils 34 have anvil teeth 37. The anvil teeth may be oriented in a direction opposite to that of the rotary crusher teeth as shown. The anvil teeth may have the same size and spacing as the rotary crusher teeth, although in other embodiments, the anvil teeth may have a different size and/or spacing as compared to the rotary crusher teeth.

Optionally, the rotary crusher teeth 35 and the anvil teeth 37 are shaped to create a scissoring action when passing each other.

Figure 2:
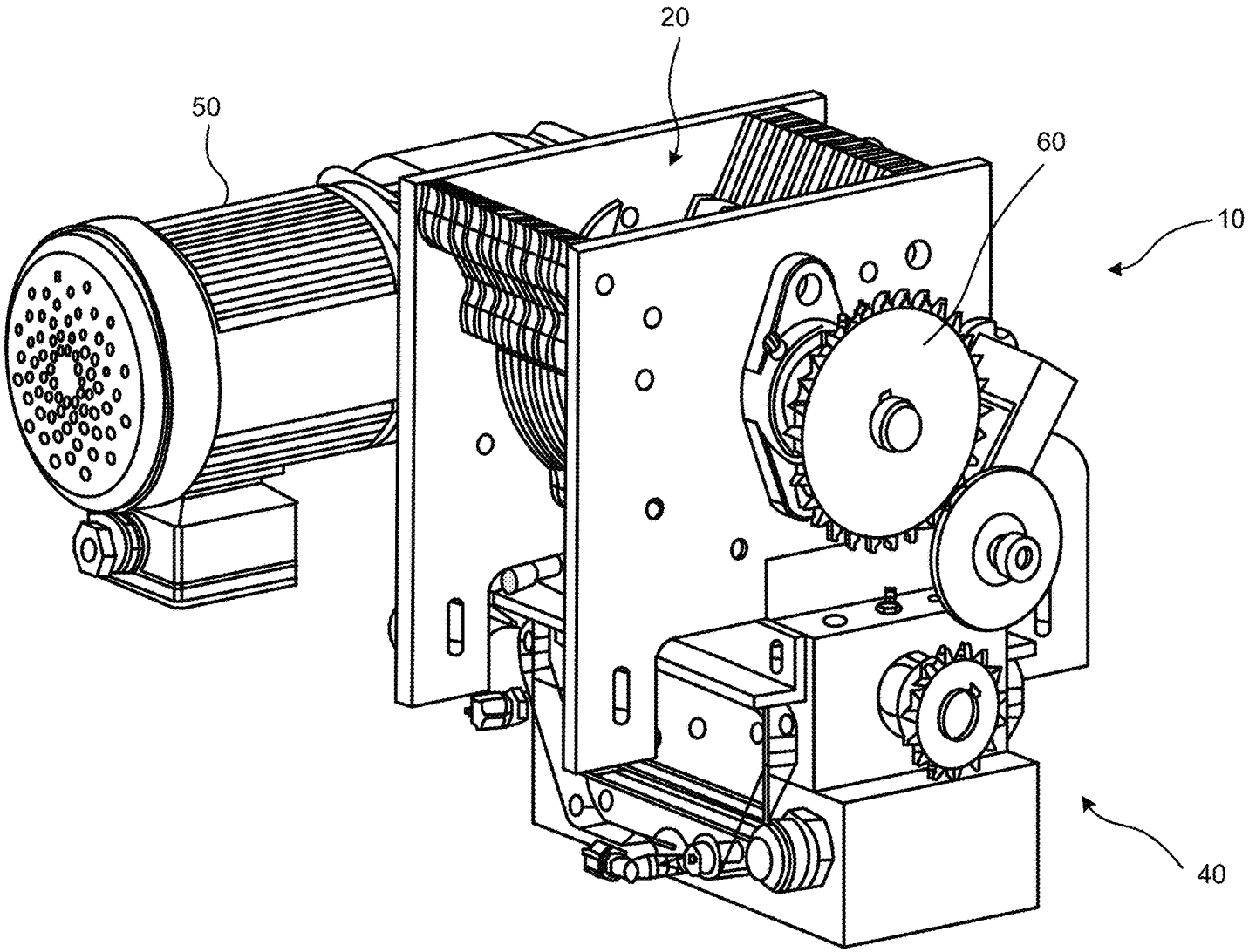
FIG. 2 depicts a crusher assembly showing the feeder assembly on the bottom, the sprocket assembly for driving the feeder and crusher, a chain tensioner, electric motor, side plates, bearings and guide plates.
Figure 3:
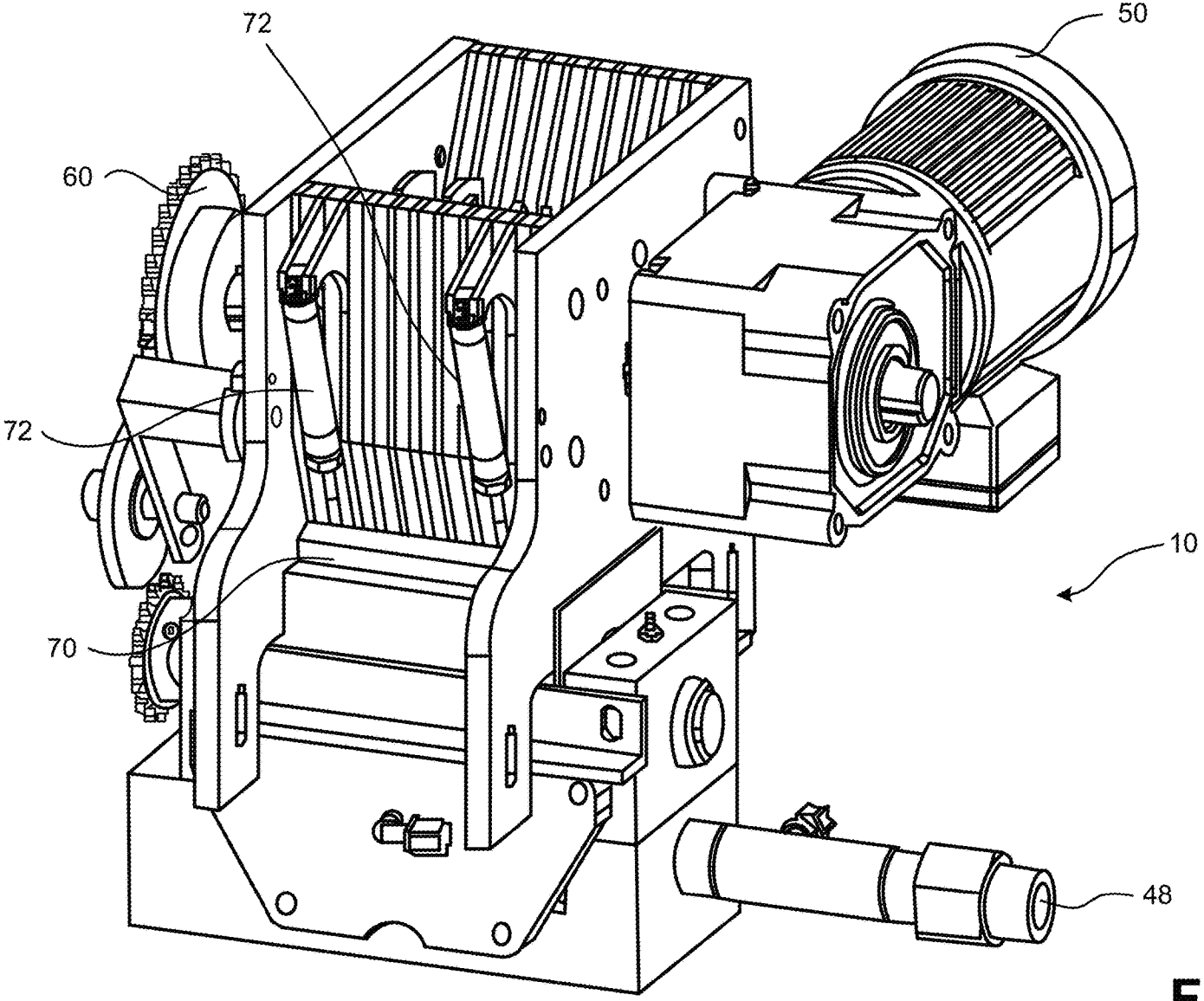
FIG. 3 is an isometric view of the crusher assembly showing a pneumatically activated ice piston.

The rotary crusher arms are separated by arm spacers and the anvils are spaced by anvil spacers so that the rotary crusher arms and anvils are interleaved or interlaced as depicted in FIGS. 1-3.

In the illustrated embodiment, the rotary crusher arms are curved or concave. This concave shape of the arms draws the ice toward a central part of the crushing zone.

As depicted in FIG. 2, the crusher shaft, hub and crusher arms are driven by a motor, e.g. an electric motor 50. Any other suitable motor, engine, power plant or prime mover may be used. FIG. 2 also depicts a drive chain and sprocket mechanism 60 used in this embodiment to drive both the rotary feeder mechanism and the rotary crusher using the motor (i.e. the crusher and feeder may be powered using a common motor). This drive chain and sprocket mechanism 60 enables the rotary crusher 30 and the feeder mechanism 40 to be synchronized. The chain and sprocket mechanism may be replaced by a belt drive, a gearbox or other suitable transmission system.

As depicted in FIGS. 2 and 3, the motor 50 may be orthogonal to the crusher shaft 31 for compactness although other motor-shaft layouts may be utilized.

In the embodiment depicted in FIG. 1, the system has an ice piston 70 to force the crushed ice into the ice-receiving pockets 44 of the rotary feeder mechanism 40. In some embodiments, the ice piston 70 is a pneumatically driven ice piston. In one specific embodiment, the pneumatically driven ice piston is powered by an air source (e.g. air compressor) that also provides the high-pressure airstream to the rotary feeder mechanism 40. The ice piston may alternatively be hydraulically driven. The ice piston may have a mechanical linkage to convert rotary motion of a motor to reciprocating motion.

FIG. 3 depicts an ice-pushing mechanism employing two parallel pneumatic cylinders 72 to drive the ice piston 70.

Figure 4:
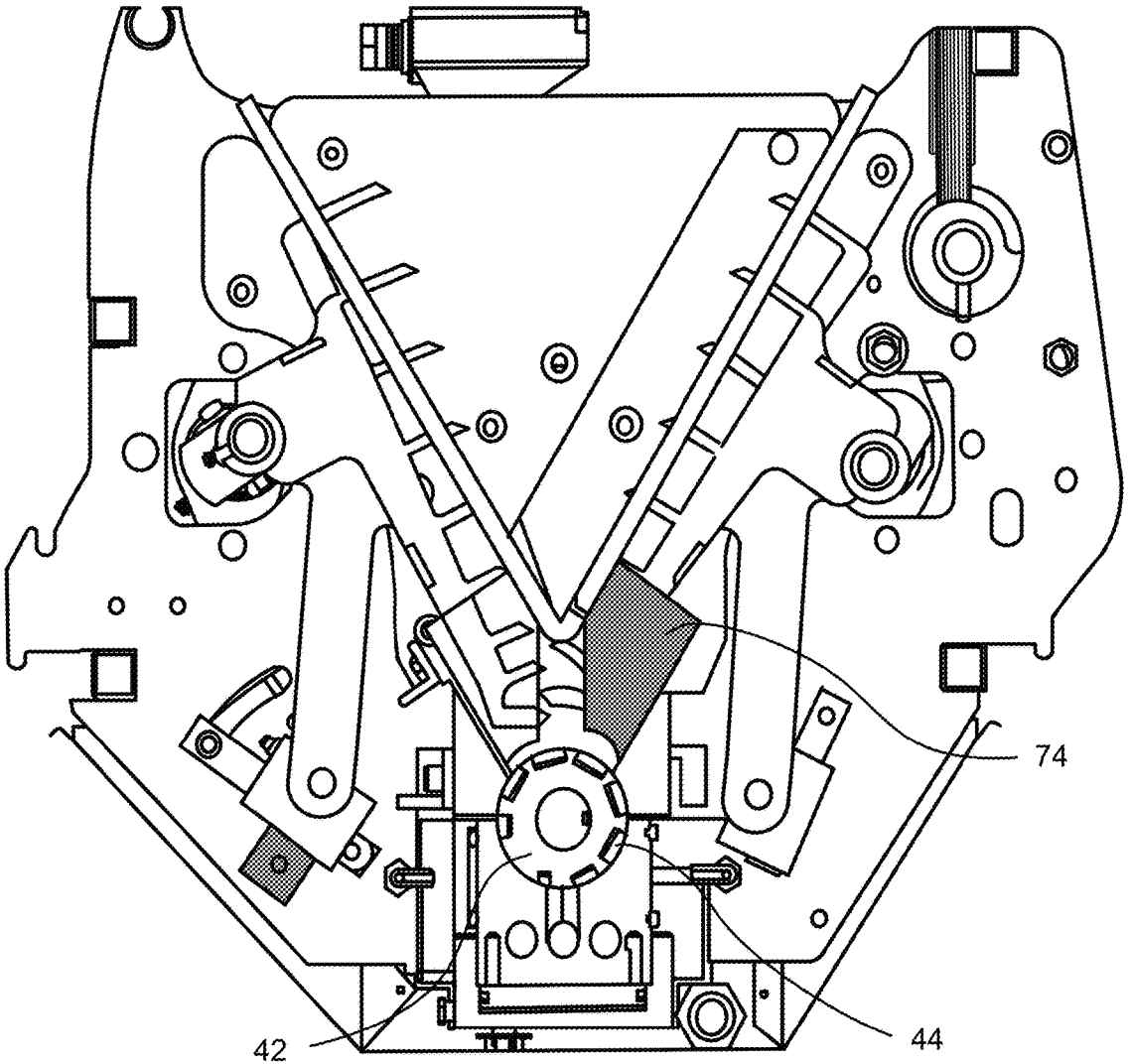
FIG. 4 is a sectional view of a V-jaw style crusher showing locations of the comb-blocks that perform the pushing action on the crushed ice to force it into the feeder.

As depicted in the embodiment of FIG. 4, the system further comprises a comb-block 74 attached to the ice piston to push the crushed ice into the ice-receiving pockets 44 of the rotor 42.

Figure 5:
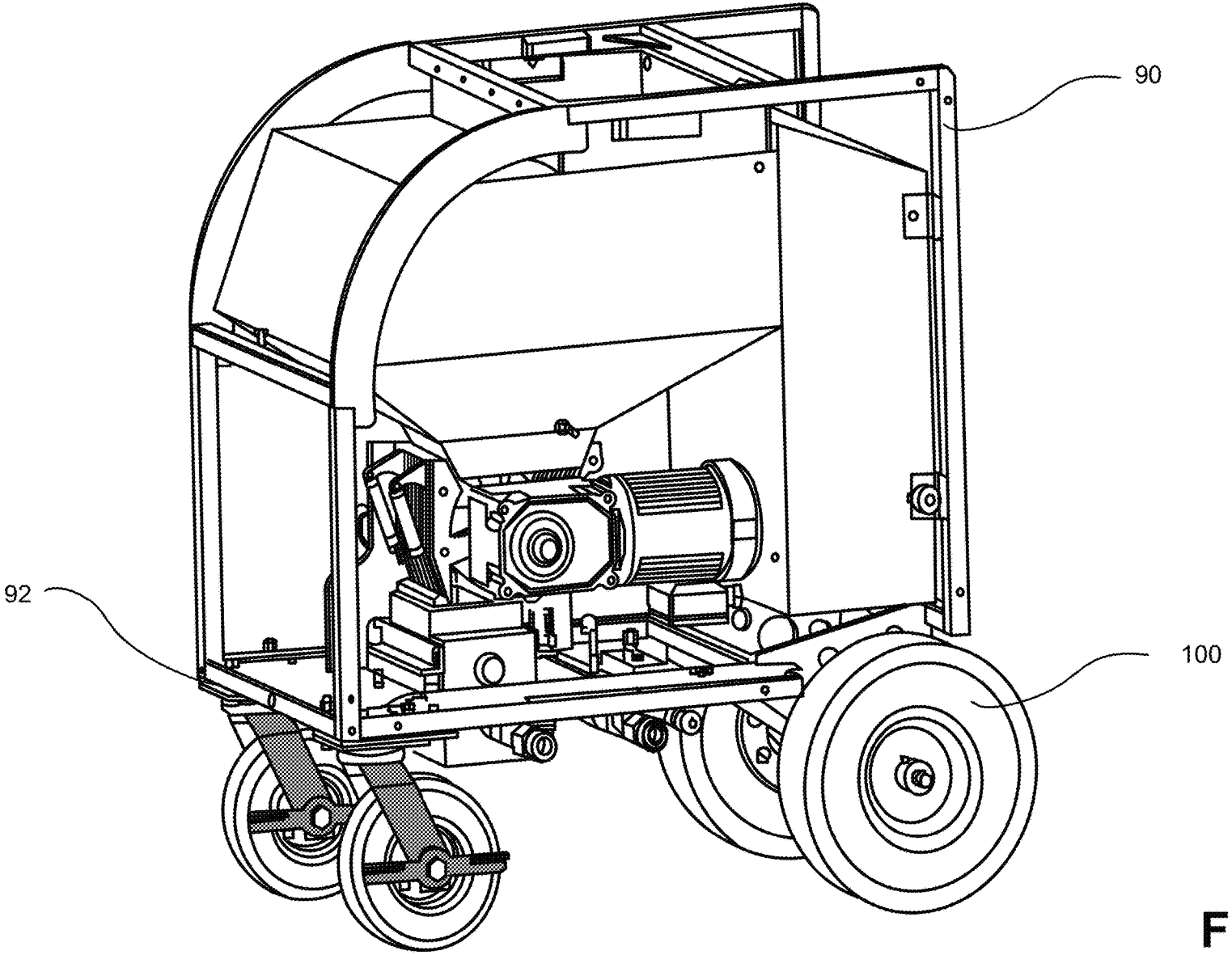
FIG. 5 depicts an ice blasting system (or ice blasting machine) showing the crusher, feeder, motor assembly, frame, ice hopper, electrical control box, frame, wheels, and inlet flow header.
Figure 6:
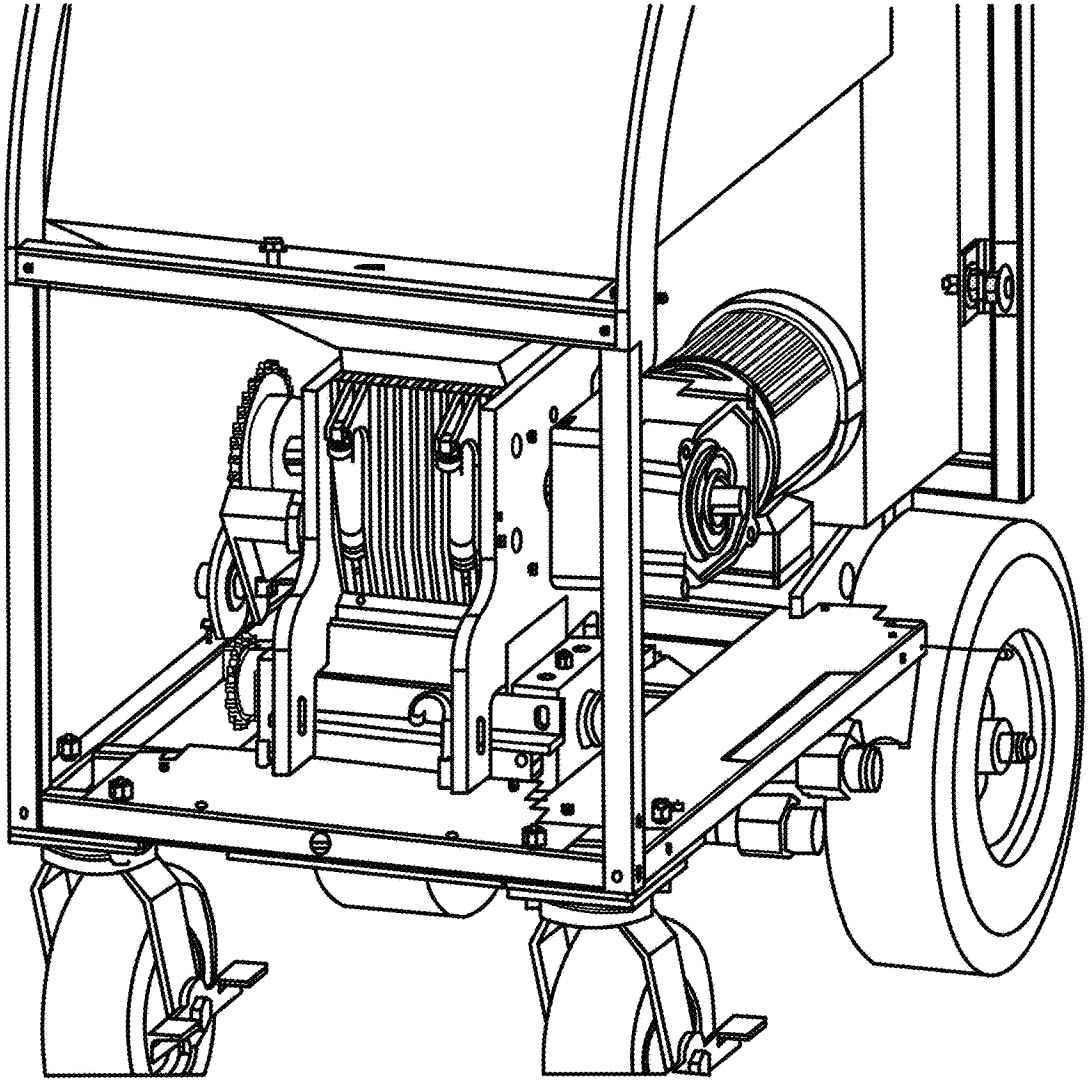
FIG. 6 is an isometric view of the ice blasting system showing the crusher inside the frame.
Figure 7:
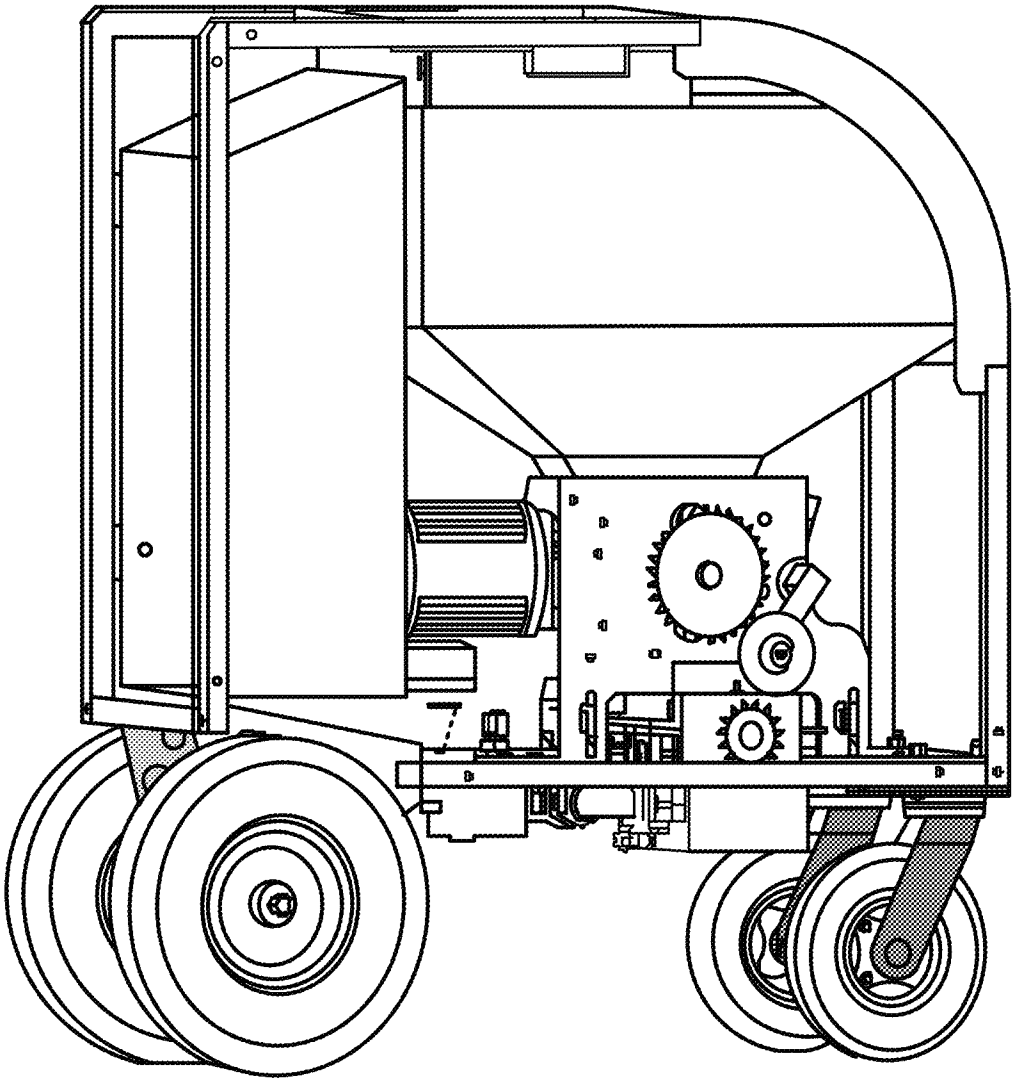
FIG. 7 is a view of the ice blasting system depicting the frame, crusher, inlet header, electrical box and drive sprockets.

In the embodiment depicted in FIGS. 5-7, the ice blasting system further comprises a frame 90 and a plurality of wheels 100 mounted to a bottom portion 92 of the frame. The ice blasting system is thus portable or mobile. It will be appreciated that, in another embodiment, the ice blasting system may not have any wheels.

Figure 8:
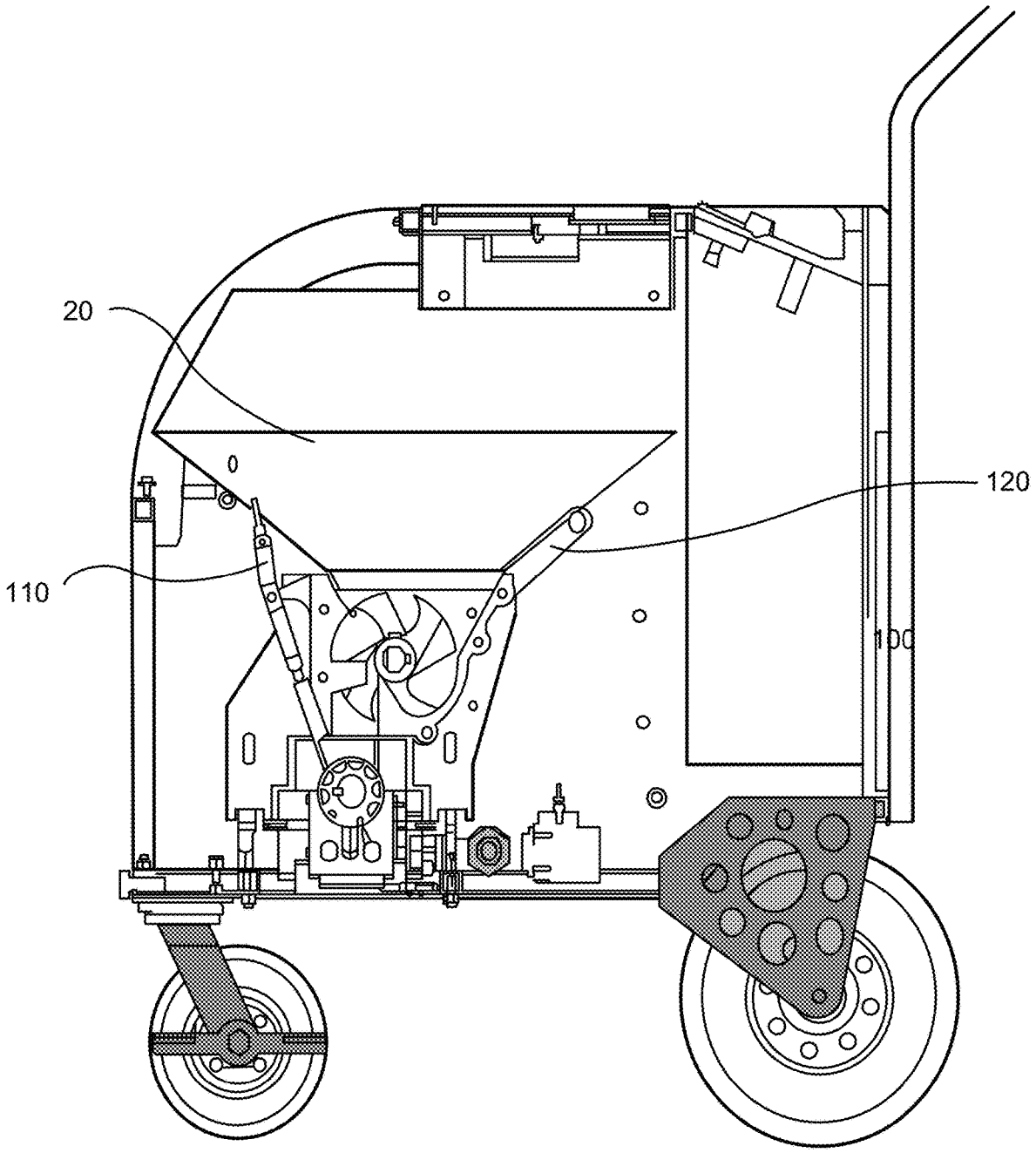
FIG. 8 is a cutaway view of the ice blasting system showing the hopper with agitation piston attached to the crusher frame and pivot bar.
Figure 9:
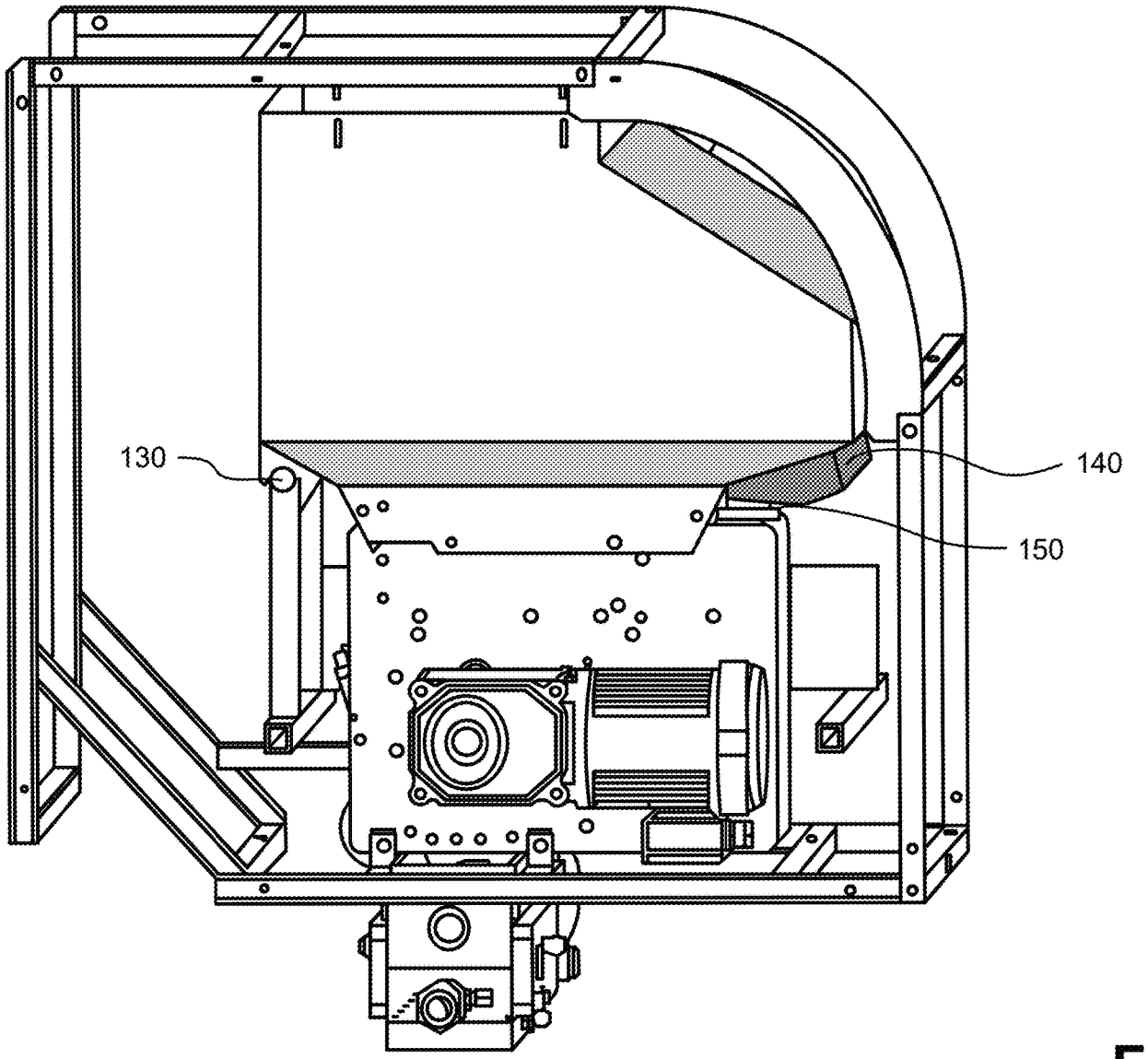
FIG. 9 depicts another embodiment of a hopper agitation system using a pivot point at left, an impact bar at right, and a pancake piston to alternately lift and drop the hopper as it pivots around the pivot point.

As depicted by way of example in FIGS. 8 and 9, the ice blasting system optionally includes a hopper agitation system to facilitate entry of the crushed ice into the ice-receiving pockets. The hopper agitation system comprises a mechanism to displace the hopper relative to a frame of the ice blasting system to jostle the crushed ice in the hopper.

In the embodiment depicted in FIG. 8, the hopper agitation system comprises an agitation piston 110 connected to the frame and a pivot bar 120 to enable pivoting of the hopper 20.

In the embodiment depicted in FIG. 9, the hopper agitation system comprises a pivot point 130, an impact bar 140 and a piston (e.g. a low-profile or pancake-style piston) 150 to lift and drop the hopper.

Figure 10:
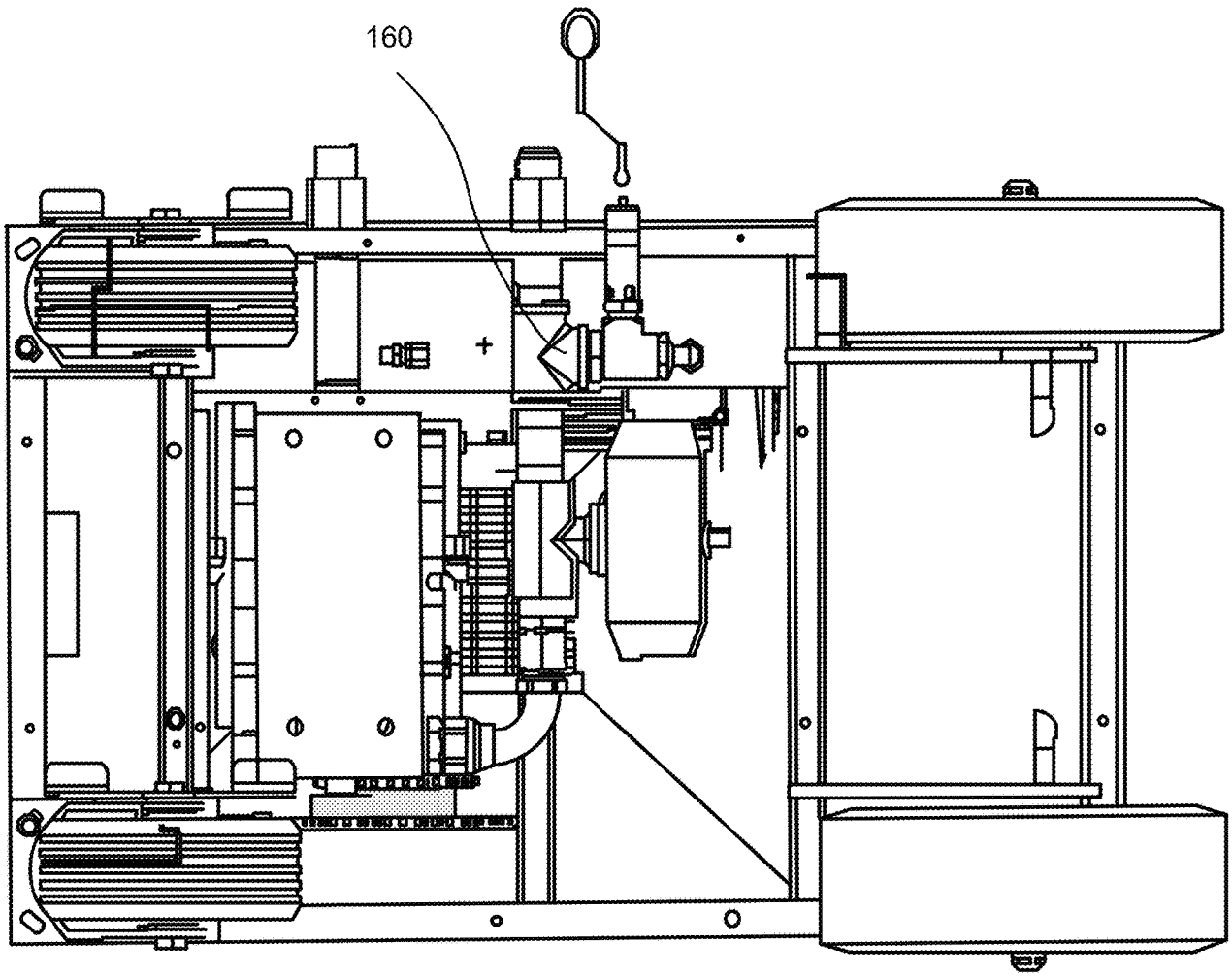
FIG. 10 is a bottom view of the ice blasting system showing routing of the inlet header.

FIG. 10 shows the underside of the ice blasting system 10. This figures shows the routing of the inlet header 160.

The rotary feeder mechanism 40 is further described with reference to FIGS. 11-15.

Figure 11:
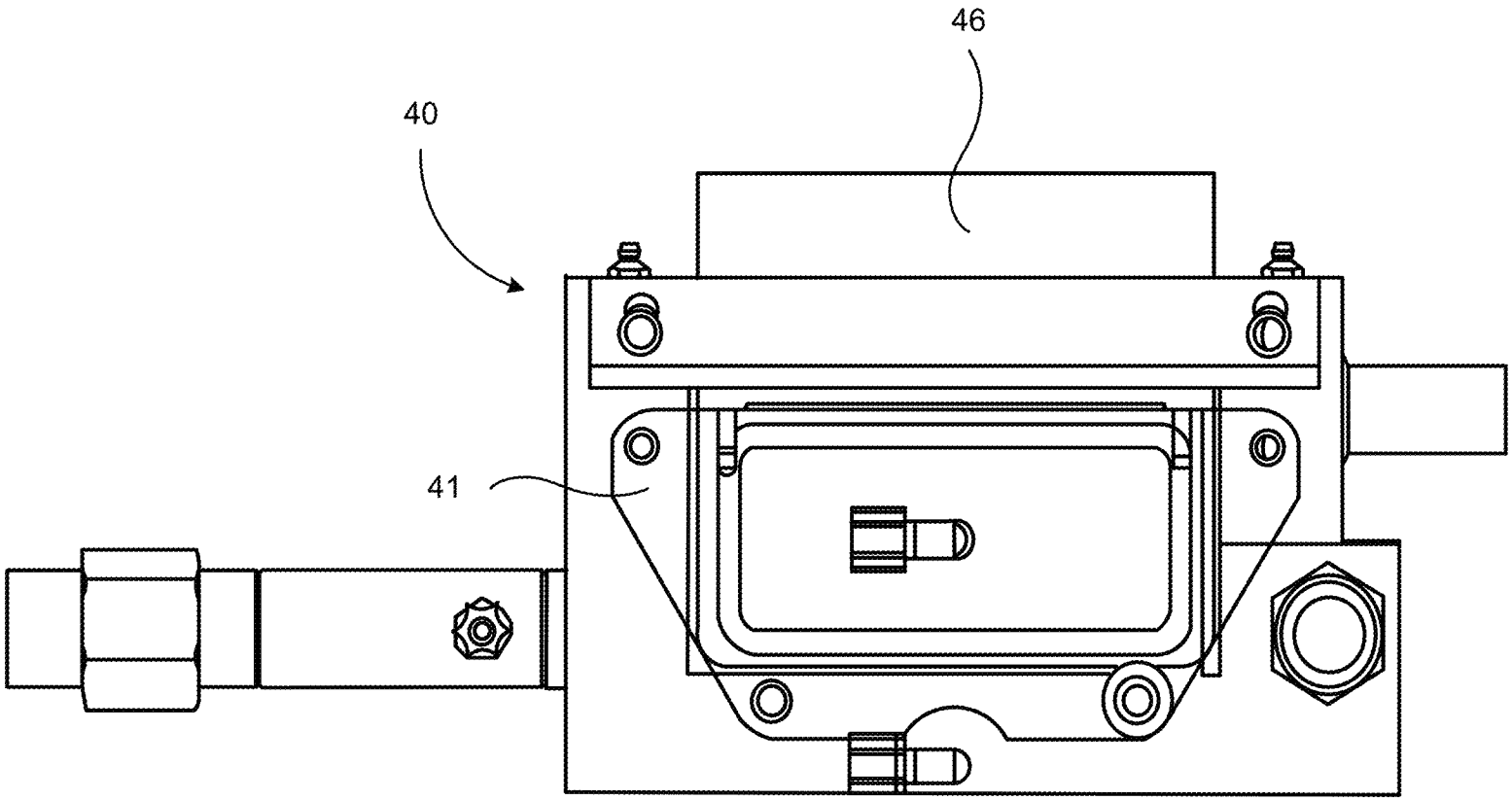
FIG. 11 depicts a feeder assembly showing pressurized side plates.
Figure 12:
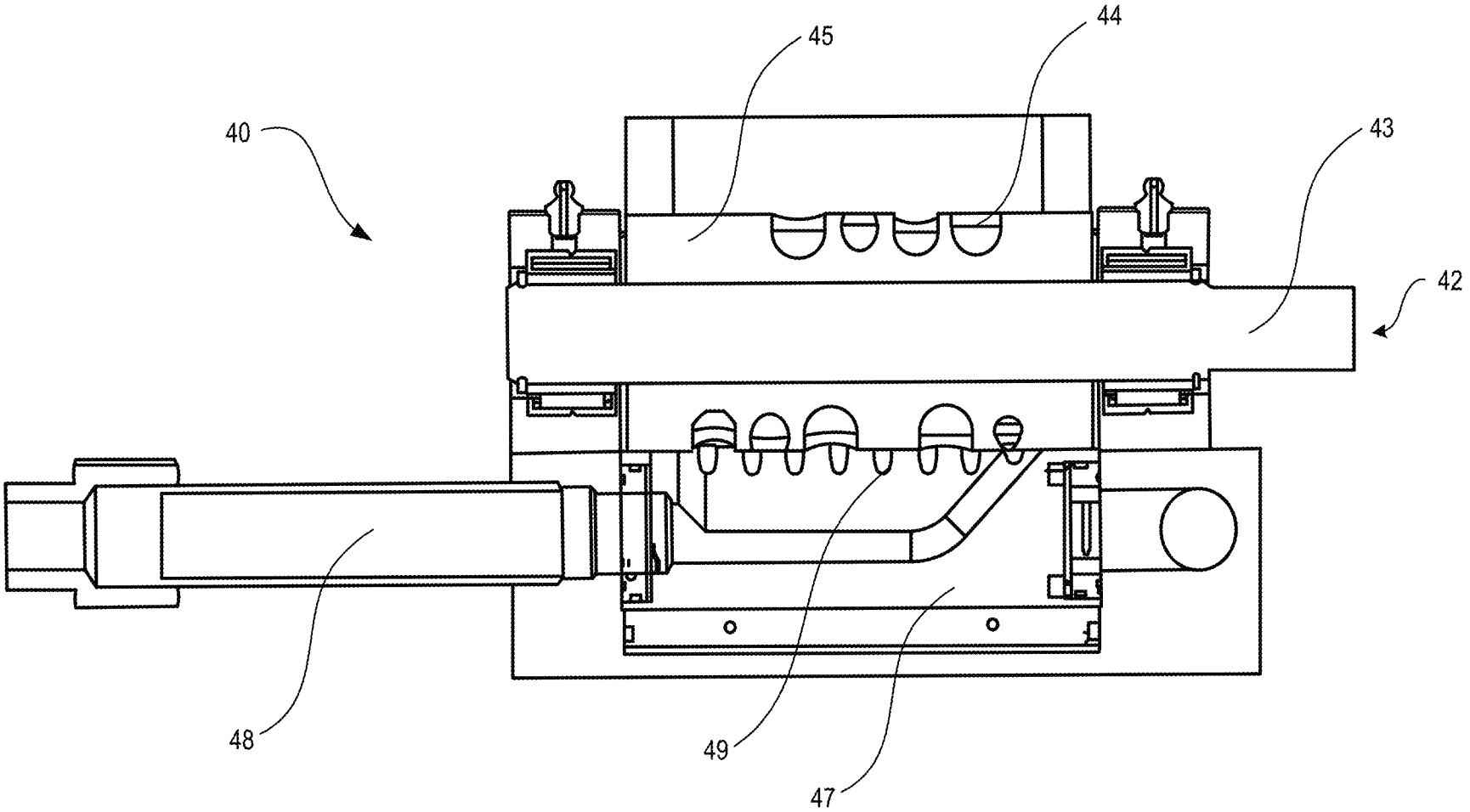
FIG. 12 is a cutaway view of the feeder assembly, showing a pressurized bottom plate, floating seal inserts at each end of the seal block, two-part rotor assembly with an inner shaft and outer sleeve with pockets, top seal that rides on top of the rotor and prevents air leakage entering the hopper.

As depicted in FIGS. 11-12, the seal block 46 comprises pressure-activated panels 41 that press the seal block against the rotor 42 when a rotor cavity 47 is pressurized.

In the embodiment depicted in FIG. 12, the rotor 42 is formed of a two-part rotor assembly. In this embodiment, the rotor 42 comprises an inner shaft 43 and an outer rotor sleeve 45 rotationally connected to the inner shaft wherein the outer rotor sleeve includes the ice-receiving pockets 44. The pockets 44 deliver the crushed ice into the pressurized rotor cavity 47 sealed by airtight seals 49. The crushed ice is entrained in the pressurized airstream and then exits via the outlet 48.

Figure 13:
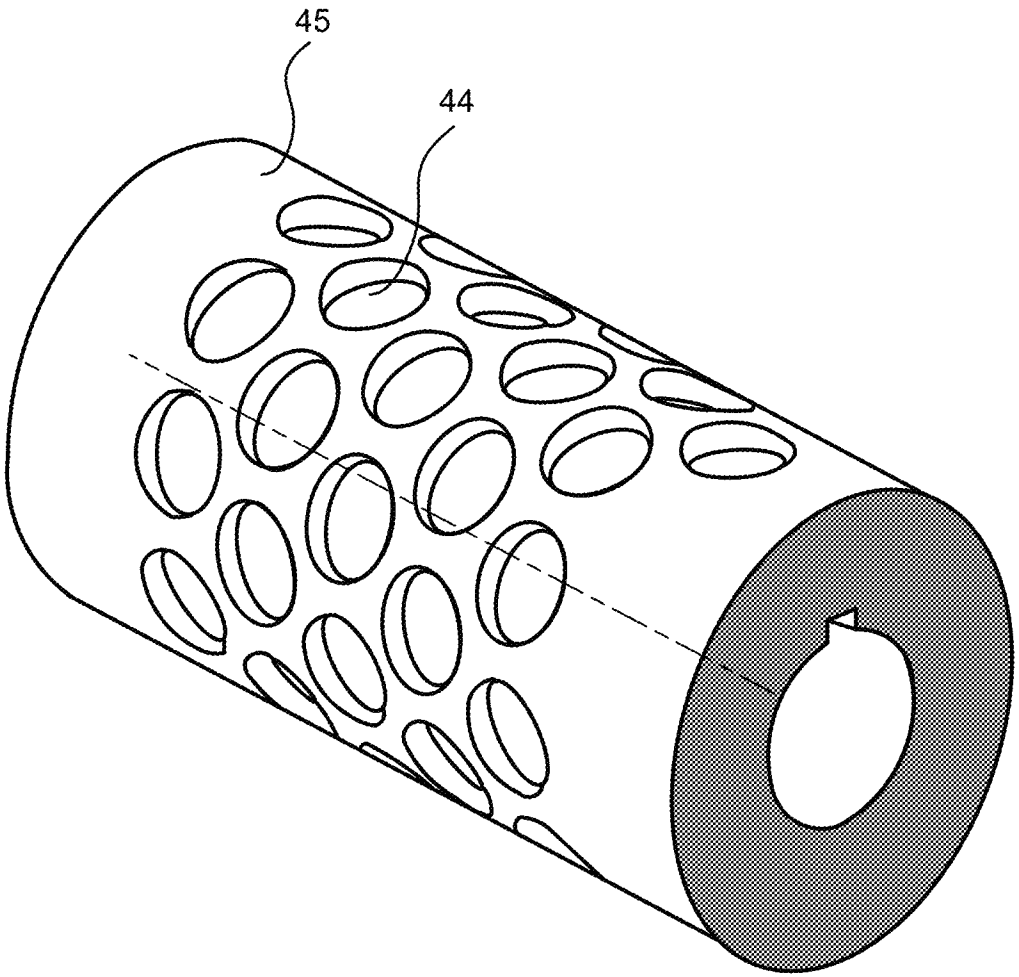
FIG. 13 depicts an outer rotor sleeve, showing a spiral pocket pattern in the outer surface, in which the holes are more widely spaced in this embodiment to improve sealing.

In the embodiment depicted in FIG. 13, the ice-receiving pockets 44 in the outer rotor sleeve 45 form a spiral pocket pattern.

Figure 14:
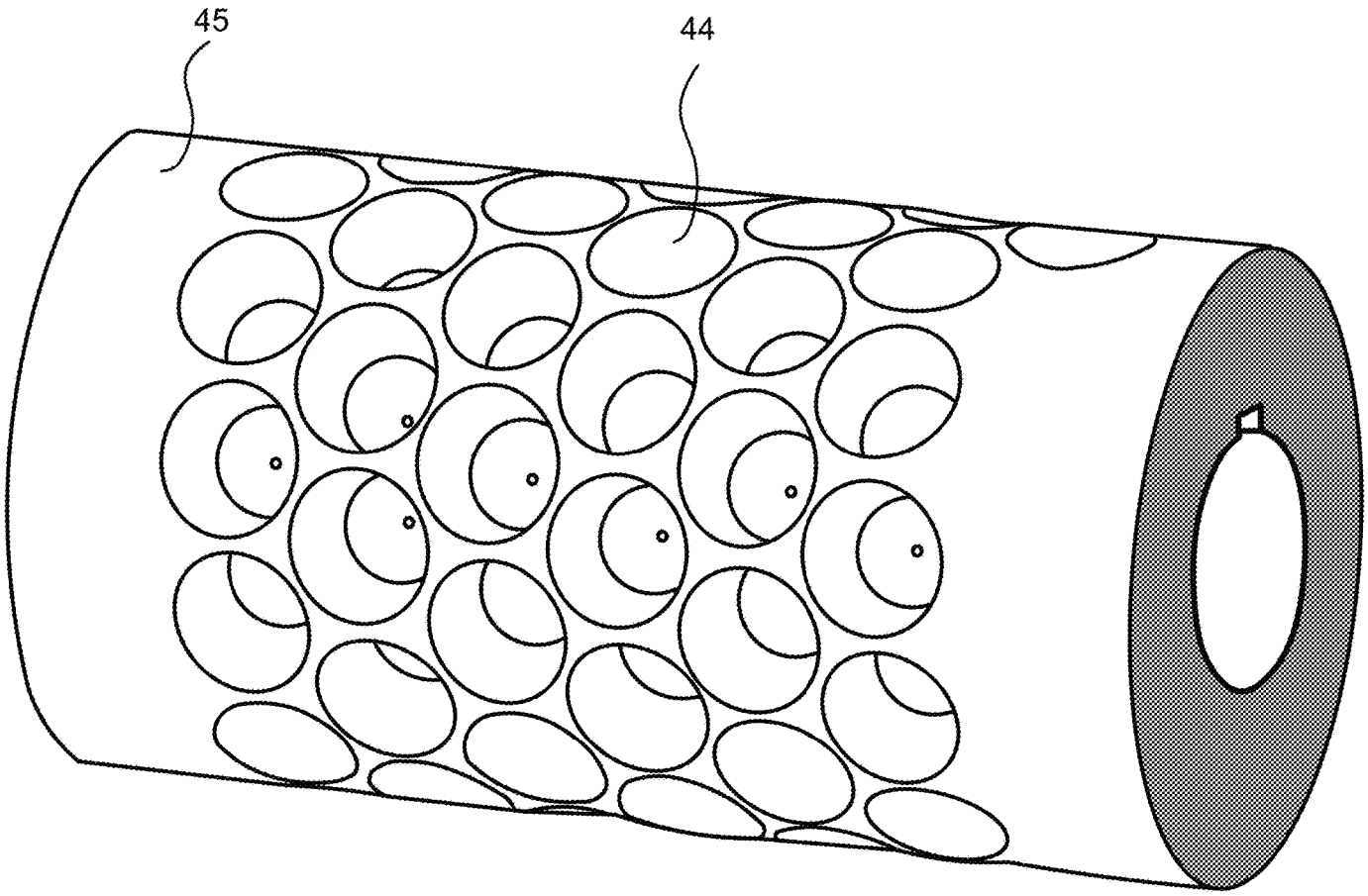
FIG. 14 depicts an outer rotor sleeve showing more closely spaced holes to increase volume flow rate per revolution.

In the embodiment depicted in FIG. 14, the ice-receiving pockets 44 are more closely spaced than in FIG. 13. The embodiment of FIG. 14 provides a greater volume flow rate. However, the embodiment of FIG. 13 provides a better seal between the rotor and seal block.

Figure 15:
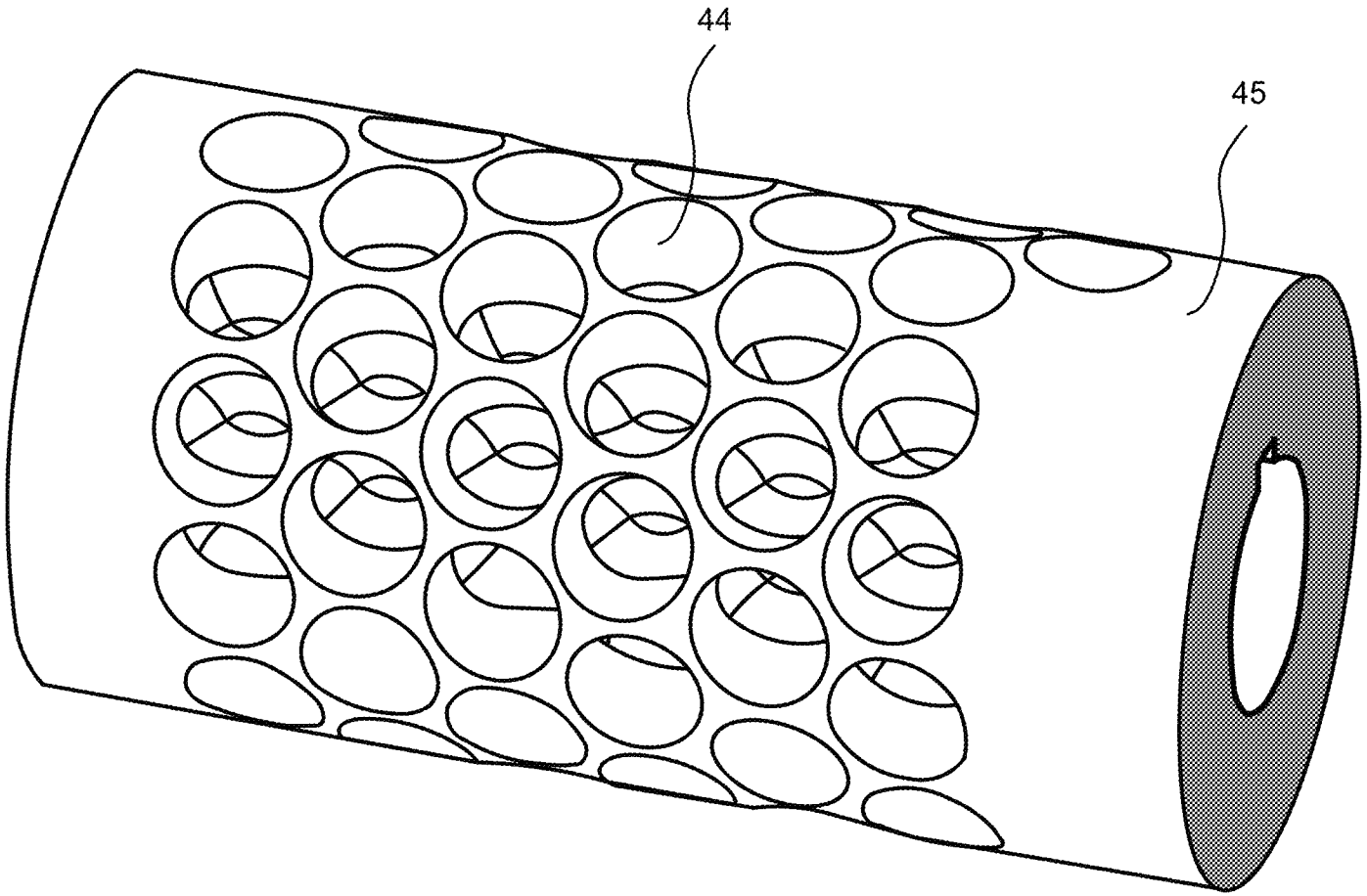
FIG. 15 depicts an outer rotor sleeve showing holes with circular tops and oval bottoms to maximize the volume flow rate per revolution.

In the embodiment depicted in FIG. 15, the ice-receiving pockets 44 are holes having circular tops and oval bottoms to maximize a volume flow rate per revolution.

For the purposes of interpreting this specification, when referring to elements of various embodiments of the present invention, the articles "a", "an", "the" and "said" are intended to mean that there are one or more of the elements. The terms "comprising", "including", "having", "entailing" and "involving", and verb tense variants thereof, are intended to be inclusive and open-ended by which it is meant that there may be additional elements other than the listed elements.

This invention has been described in terms of specific implementations and configurations which are intended to be exemplary only. Persons of ordinary skill in the art will appreciate that many obvious variations, refinements and modifications may be made without departing from the inventive concepts presented in this application. The scope of the exclusive right sought by the Applicant(s) is therefore intended to be limited solely by the appended claims.

What is claimed is:

1. An ice blasting system comprising:

a hopper to receive bulk ice;

a V-shaped crusher having crushing teeth to crush the bulk ice to make crushed ice;

a rotary feeder mechanism disposed below the hopper, the rotary feeder mechanism having a rotor that includes ice-receiving pockets for receiving the crushed ice, wherein the rotor rotates against an airtight seal block and delivers the crushed ice into a high-pressure airstream passing through the rotary feeder mechanism to thereby entrain the crushed ice into the high-pressure airstream, the ice-entrained airstream subsequently exiting the ice blasting system through an outlet;

a hopper agitation system to facilitate entry of the crushed ice into the ice-receiving pockets, wherein the hopper agitation system comprises a mechanism to displace the hopper relative to a frame of the ice blasting system to jostle the crushed ice in the hopper; and a comb-block attached to an ice piston to push the crushed ice into the ice-receiving pockets, wherein the ice-receiving pockets are holes spaced in a spiral pattern, the holes having circular tops and oval bottoms to maximize a volume flow rate per revolution.

2. The system of claim 1 wherein the ice piston is pneumatically driven.

3. The system of claim 1 wherein the ice piston is hydraulically driven.

4. The system of claim 1 wherein the rotor comprises an outer rotor tube having a hollow bore and an inner through-shaft coupled to the outer rotor tube by a keyway or spline.

5. The system of claim 4 wherein the seal block is made of ultrahigh molecular weight plastic and wherein the outer rotor tube is made of aluminum, the ultrahigh molecular weight plastic having a coefficient of thermal expansion greater than a coefficient of thermal expansion of the aluminum.

6. The system of claim 1 wherein the hopper agitation system comprises an agitation piston connected to a frame that supports the hopper, wherein the hopper agitation system also comprises a pivot bar to enable pivoting of the hopper relative to the frame.

7. The system of claim 1 wherein the hopper agitation system comprises a pivot point, an impact bar and a piston to lift the hopper relative to a frame and to drop the hopper onto the frame.

8. The system of claim 1 wherein the seal block comprises pressure-activated panels that press the seal block against the rotor when a rotor cavity of the rotor is pressurized.

* * * * *